US010434630B2

(12) United States Patent
Turner et al.

(10) Patent No.: US 10,434,630 B2
(45) Date of Patent: Oct. 8, 2019

(54) VAPOR ABRASIVE BLASTING SYSTEM WITH CLOSED LOOP FLOW CONTROL

(71) Applicant: Graco Minnesota Inc., Minneapolis, MN (US)

(72) Inventors: John W. Turner, Coon Rapids, MN (US); Nicholas K. Studt, Roberts, WI (US); Bryce J. Gapinski, Foley, MN (US); Brandon K. Falkenberg, New Richmond, WI (US)

(73) Assignee: Graco Minnesota Inc., Minneapolis, MN (US)

( * ) Notice: Subject to any disclaimer, the term of this patent is extended or adjusted under 35 U.S.C. 154(b) by 180 days.

(21) Appl. No.: 15/599,023

(22) Filed: May 18, 2017

(65) Prior Publication Data

US 2017/0334036 A1 Nov. 23, 2017

Related U.S. Application Data

(60) Provisional application No. 62/338,147, filed on May 18, 2016.

(51) Int. Cl.
*B24C 7/00* (2006.01)

(52) U.S. Cl.
CPC ..... *B24C 7/0015* (2013.01); *B24C 7/0007* (2013.01); *B24C 7/0023* (2013.01)

(58) Field of Classification Search
CPC ..... B24C 7/00; B24C 7/0007; B24C 7/0015; B24C 7/0023
USPC ..... 451/5
See application file for complete search history.

(56) References Cited

U.S. PATENT DOCUMENTS 3,769,752 A * 11/1973 McDonald ..... B24C 3/00 451/67
5,018,317 A * 5/1991 Kiyoshige ..... B24C 1/045 451/102
5,018,670 A * 5/1991 Chalmers ..... B24C 5/04 239/433
5,065,551 A * 11/1991 Fraser ..... B05B 7/1431 451/40

(Continued)

FOREIGN PATENT DOCUMENTS

JP 2005299519 A * 10/2005
JP 2009166170 A * 7/2009
WO WO02085573 A1 10/2002

OTHER PUBLICATIONS

JP-2009166170-A (Translation), Jul. 2009, JP, Kitagawa, Yasuyuki.*

(Continued)

*Primary Examiner* — Timothy V Eley
(74) *Attorney, Agent, or Firm* — Kinney & Lange, P.A.

(57) ABSTRACT

A blasting system includes a pressure vessel, water pump, blast circuit, motor, orifice valve, and controller. The pressure vessel is configured to contain a pressurized blast media slurry. The water pump pumps water from a water supply to the pressure vessel. The blast circuit delivers the pressurized blast media slurry received from the pressure vessel. The motor drives the water pump. The orifice valve regulates a rate of flow of the blast media slurry to the blast circuit. The controller provides control commands to the water pump or the orifice valve based on a blast media flow rate set point and at least one sensed operating parameter.

15 Claims, 6 Drawing Sheets

(56) References Cited

U.S. PATENT DOCUMENTS 5,304,001 A * 4/1994 Kuo ..... B01F 15/0412 366/132
5,325,638 A * 7/1994 Lynn ..... B24C 7/0053 451/39
5,412,910 A * 5/1995 Woodson ..... B05B 7/1404 451/38
5,556,325 A * 9/1996 Shank, Jr. ..... B24C 1/003 451/100
5,591,064 A * 1/1997 Spears, Jr. ..... B24C 7/0053 451/100
5,782,673 A * 7/1998 Warehime ..... B24C 1/045 451/2
5,795,060 A * 8/1998 Stephens ..... B01F 3/12 366/10
5,968,312 A * 10/1999 Sephton ..... B01D 1/065 159/18
6,062,957 A * 5/2000 Klaft ..... B24C 3/02 451/101
6,119,964 A * 9/2000 Lombari ..... B24C 5/04 239/418
6,126,524 A * 10/2000 Shepherd ..... B24C 1/00 134/172
6,155,245 A * 12/2000 Zanzuri ..... B24C 1/045 125/1
6,168,503 B1 * 1/2001 Pao ..... B24C 5/04 451/40
6,283,832 B1 * 9/2001 Shepherd ..... B24C 1/045 451/102
6,283,840 B1 * 9/2001 Huey ..... B24B 37/04 451/288
6,676,039 B2 * 1/2004 Lindsey ..... B24C 1/045 239/310
6,752,685 B2 * 6/2004 Ulrich ..... B24C 1/045 451/102
6,769,959 B2 * 8/2004 Chen ..... B24B 37/04 451/285
6,796,934 B1 * 9/2004 McAlister ..... B04B 1/00 494/56
6,926,584 B2 * 8/2005 Chang ..... B24B 37/04 451/11
7,040,959 B1 * 5/2006 Panuska ..... B24C 5/02 239/310
7,182,671 B1 2/2007 Shimizu et al.
7,297,048 B1 * 11/2007 Reilley ..... B24C 7/0053 451/36
7,524,233 B1 * 4/2009 Reilley ..... B24C 5/04 451/38
7,549,911 B2 * 6/2009 Nguyen ..... F16K 39/022 251/121
8,128,461 B1 * 3/2012 O'Moore ..... B24B 57/02 451/285
8,308,525 B2 * 11/2012 Hashish ..... B24C 5/02 451/102
8,360,817 B2 * 1/2013 Ishii ..... B24B 37/04 451/285
8,375,757 B2 * 2/2013 Suzuki ..... B24C 7/0046 72/53
8,535,113 B2 * 9/2013 Weidert ..... B05B 12/00 451/2
8,821,213 B2 * 9/2014 Liu ..... B24C 1/045 451/2
8,961,271 B2 2/2015 Roden
8,973,523 B2 * 3/2015 Kokott ..... B05B 7/1404 118/308
8,986,074 B2 * 3/2015 Eliason ..... B24C 7/0038 137/599.03
9,138,863 B2 * 9/2015 Schubert ..... B24C 1/045
2002/0052175 A1 * 5/2002 Pettit ..... B24B 37/04 451/60
2002/0173220 A1 * 11/2002 Lewin ..... B24C 1/045 451/2
2003/0092364 A1 * 5/2003 Erickson ..... B24C 1/045 451/75
2004/0057334 A1 * 3/2004 Wilmer ..... B01F 3/0803 366/136
2005/0003747 A1 * 1/2005 Dore ..... B24C 7/0038 451/90
2005/0242310 A1 * 11/2005 Takiguchi ..... F15B 11/003 251/28
2007/0042676 A1 * 2/2007 Shimizu ..... B24C 3/065 451/5
2008/0287039 A1 * 11/2008 Connelly ..... B24C 3/06 451/38
2010/0005904 A1 * 1/2010 Igarashi ..... G01F 1/42 73/861.61
2010/0115932 A1 * 5/2010 Kassel ..... F01N 3/208 60/299
2010/0211429 A1 * 8/2010 Benson ..... B24C 9/00 700/174
2011/0162742 A1 * 7/2011 Ulens ..... F24D 19/1015 137/624.27
2012/0021676 A1 * 1/2012 Schubert ..... B24C 1/045 451/38
2012/0118562 A1 * 5/2012 McAfee ..... E21B 7/18 166/222
2013/0157546 A1 * 6/2013 Roden ..... B24C 7/00 451/101
2013/0210319 A1 * 8/2013 Gramling ..... B24C 3/00 451/2
2013/0214059 A1 * 8/2013 Gilpatrick ..... B08B 3/026 239/289
2013/0284440 A1 * 10/2013 McAfee ..... E21B 43/114 166/298
2014/0093434 A1 * 4/2014 Kassel ..... F01N 3/208 422/168
2014/0261824 A1 * 9/2014 Byers ..... B24B 57/02 137/896
2014/0269144 A1 * 9/2014 Ayo ..... E21B 33/13 366/8
2014/0363548 A1 * 12/2014 Njaastad ..... A23L 2/54 426/231
2014/0378028 A1 * 12/2014 Hayden ..... B24C 7/0023 451/2
2015/0021358 A1 * 1/2015 Shimono ..... F23K 3/02 222/55
2015/0105001 A1 * 4/2015 Eliason ..... B24C 7/0053 451/40
2015/0151258 A1 * 6/2015 Cohen ..... B01F 3/04794 261/61
2015/0231761 A1 * 8/2015 Roden ..... B24C 1/086 451/38
2015/0233184 A1 * 8/2015 Pettay ..... E02F 3/9206 239/11
2017/0204840 A1 * 7/2017 Keijers ..... F04B 23/06

OTHER PUBLICATIONS

JP-2005299519-A (Translation), Oct. 2005, JP, Fukushima, Yuki.*
International Search Report and Written Opinion for PCT Application No. PCT/US2017/033341, dated Aug. 7, 2017, 14 Pages.

* cited by examiner

VAPOR ABRASIVE BLASTING SYSTEM WITH CLOSED LOOP FLOW CONTROL

CROSS-REFERENCE TO RELATED APPLICATION(S)

This application claims priority to U.S. Provisional Application No. 62/338,147 filed on May 18, 2016, and entitled "CLOSED LOOP FLOW CONTROL ON VAPOR ABRASIVE BLASTING SYSTEM," the entire contents of which are hereby incorporated by reference in their entirety.

BACKGROUND

Current vapor abrasive blasting technology utilizes some sort of open loop control for metering an abrasive media/water mixture into the blast air stream. A common method utilizes an adjustable orifice valve to control the flow rate of water into a pressure vessel. In existing vapor abrasive blasting systems, the abrasive media flow rate is usually set during the initial setup of the machine at a job site. Once the pressure vessel is loaded with media and water, the operator will engage the system to begin blasting. While air and media are flowing from the nozzle, the blast air pressure is adjusted to the desired set point. After that, the orifice valve is adjusted until the operator believes the media flow rate is at the desired level.

The current technology still has a few drawbacks. First, the system has to be engaged and blasting in order to set and fine tune the abrasive flow rate. Second, any fluctuations in system pressures or adjustments to the blast air pressure require a subsequent adjustment and fine tuning of the blast media flow rate.

SUMMARY

A blasting system includes a pressure vessel, water pump, blast circuit, motor, orifice valve, and controller. The pressure vessel is configured to contain a pressurized blast media slurry. The water pump pumps water from a water supply to the pressure vessel. The blast circuit delivers the pressurized blast media slurry received from the pressure vessel. The motor drives the water pump. The orifice valve regulates a rate of flow of the blast media slurry to the blast circuit. The controller provides control commands to the water pump or the orifice valve based on a blast media flow rate set point and at least one sensed operating parameter.

A method of controlling a rate of flow of blast media in a blasting system that includes a water pump, a pressure vessel, a blast circuit, an orifice valve, and a controller includes receiving, at the controller, a blast media flow rate set point. An operating parameter of the blasting system is sensed. A sensor signal indicative of the operating parameter is received at the controller. A control signal is sent to at least one of the water pump and the orifice valve to adjust a rate of flow of blast media slurry into the blast circuit based on the blast media flow rate set point and the sensed operating parameter.

DETAILED DESCRIPTION

A flow control system for an abrasive blasting system includes a closed loop feedback control system to allow an operator to choose a desired set point upon setting up the system without having to first engage the system. Feedback on media flow rate can be obtained by using one or more sensed parameters, such as sensed pump cycle rate, sensed water flow rate into the pressure vessel, and/or change in weight of the pressure vessel over time. The media flow rate can be controlled by regulating water flow into the pressure vessel or by regulating the flow of the slurry mixture that flows from the outlet of the pressure vessel, or both. For example, the water flow into the pressure vessel can be controlled by adjusting the output of the water pump based on one or more of the sensed parameters. The feedback control system ensures the media flow rate remains accurate and consistent over a period of time.

An example of a vapor blasting system discussed herein can be found in co-pending PCT International Application No. PCT/US16/42585 titled "VAPOR BLAST SYSTEM WITH FIXED POT PRESSURE" filed on Jul. 15, 2016, which is herein incorporated by reference in its entirety.

Figure 1A:
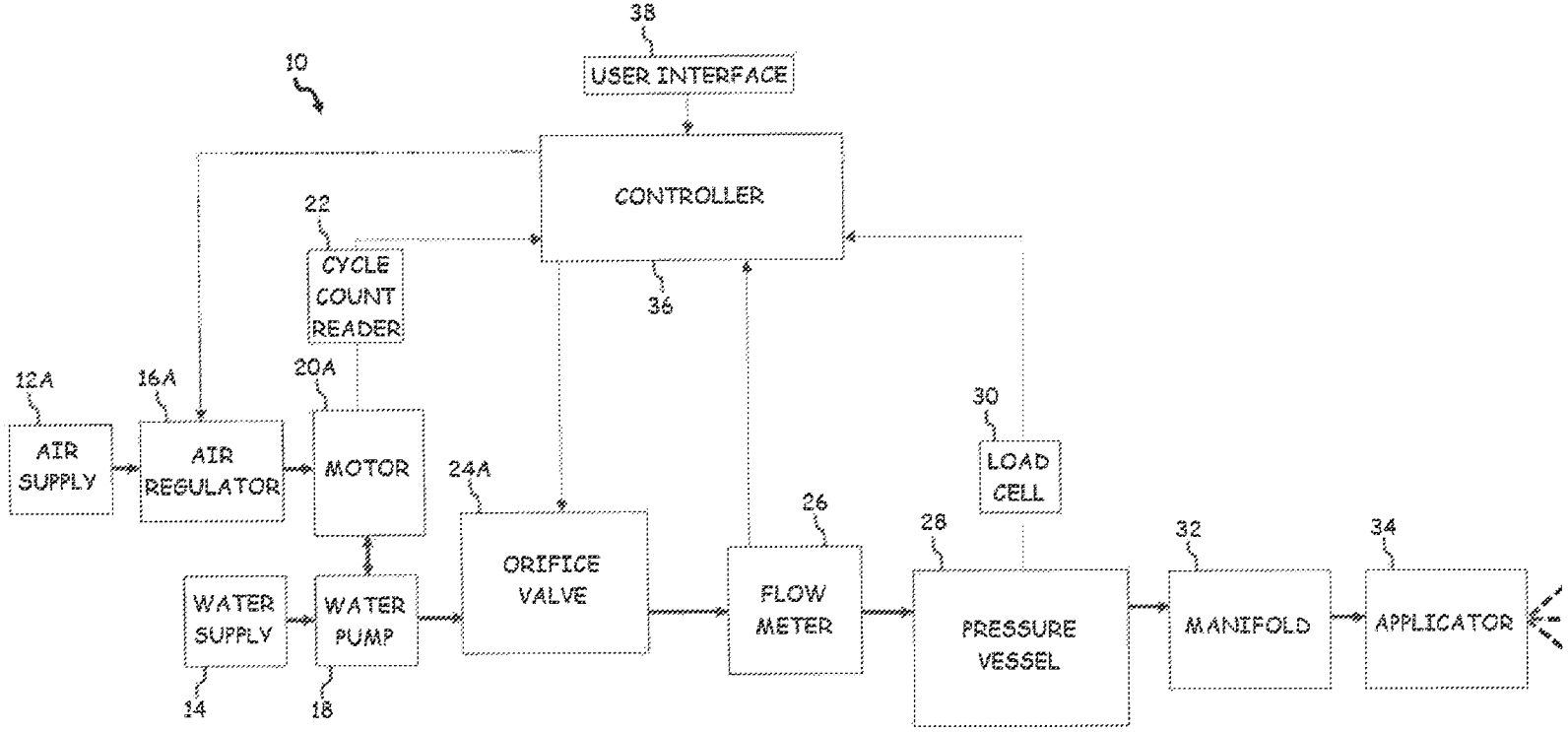
FIG. 1A is a block diagram of a vapor blasting system with an air driven motor.

FIG. 1A is a block diagram of vapor blasting system 10. In this embodiment, vapor blasting system 10 includes air supply 12A, water supply 14, air regulator 16A, water pump 18, motor 20A, cycle count reader 22, orifice valve 24A, flow meter 26, pressure vessel 28, load cell 30, manifold 32, applicator 34, controller 36, and user interface 38.

Vapor blasting system 10 is a vapor abrasive blasting system for coating removal and surface preparation. Air supply 12A is a source of gas (typically air), and can include for example a pressurized or un-pressurized air tank, air pump, or pneumatic air supply system. Water supply 14 is a source of liquid (typically water), and can include a container of pressurized or un-pressurized water. Air regulator 16A is a device configured to regulate a volume, rate, and/or pressure of a gas passing through air regulator 16A. Air regulator 16A can be manually set or controlled by a control signal. In the embodiment shown, water pump 18 is a piston pump configured to create a pressurized flow of liquid. In the non-limiting embodiment shown in FIG. 1A, motor 20A is an oscillating pneumatic motor or compressed air engine. Cycle count reader 22 is a sensor that senses pump strokes of motor 20A or water pump 18.

Orifice valve 24A is an adjustable flow regulating device or valve. In one non-limiting embodiment, orifice valve 24A can be a needle valve with a tapered pin which gradually opens a space for finely tuned control of flow. Flow meter 26 is an instrument configured to measure a flow rate of a fluid (in this case water) passing through flow meter 26. Pressure vessel 28 is a container for containing a pressurized fluid such as a blast mixture of liquid and abrasive material. Pressure vessel 28 contains a blast mixture, comprised of blast media and water, which is applied to a substrate to remove a coating from the substrate and to condition the substrate for future coating applications. The blast media may be of any suitably abrasive material such as, crushed glass, garnet, or any other heavier-than-water particulate, and may be applied to any desired substrate, such as wood, concrete, and steel, to clean or abrade the surface of the substrate.

Load cell 30 is a scale for sensing the weight, or mass, of an object, in this case pressure vessel 28 and its contents. Manifold 32 is configured to receive and output a gas and a liquid. Applicator 34 is a device for the expulsion of blast media from vapor blasting system 10. In one non-limiting embodiment, manifold 32 and applicator 34 can form a blast circuit. Controller 36 is a device configured to regulate and/or control the reception of electrical sensor signals and delivery of electrical control signals. In the embodiment shown in FIG. 1A, controller 36 includes user interface 38 configured to allow an operator to receive and view output data and enter input data and control settings into controller 36.

Air supply 12A is fluidly connected to air regulator 16A. Water supply 14 is fluidly connected to water pump 18. Air regulator 16A is fluidly connected to motor 20A. Water pump 18 is mechanically connected and driven by motor 20A. Water pump 18 includes a piston driven motor (e.g., motor 20A). Motor 20A is fluidly and mechanically connected to water pump 18 via a frame and a piston. Cycle count reader 22 is positioned in close proximity to motor 20A such that cycle count reader 22 senses each stoke or cycle of motor 20A (which is indicative of a cycle rate of water pump 18).

Orifice valve 24A is connected to an outlet of water pump 18. Flow meter 26 is connected between orifice valve 24A and pressure vessel 28, and can be attached to either orifice valve 24A or to pressure vessel 28. Pressure vessel 28 has a water inlet that is fluidly connected to the flowpath that includes water supply 14, water pump 18 orifice valve 24A, and flow meter 26. Load cell 30 is disposed underneath pressure vessel 28 such that load cell 30 is configured to sense and/or measure a weight (i.e., mass) of pressure vessel 28 and its contents (e.g., the blast media).

Manifold 32 is fluidly connected to applicator 34. In other embodiments, controller 36 can also provide a control signal to air regulator 16A to adjust the setting of air regulator 16A.

Controller 36 is electrically connected to air regulator 16A, cycle count reader 22, orifice valve 24A, flow meter 26, and load cell 30. Controller 36 is configured to receive electrical signals from air regulator 16A, cycle count reader 22, and load cell 30. Controller 36 is configured to send electrical signals to water pump 18 and orifice valve 24A.

During operation of vapor blasting system 10, cycle count reader 22 senses a cycle rate of water pump 18 (for example, by sensing strokes or cycles of water pump 18 or motor 20A), flow meter 26 senses a flow rate of water flowing into pressure vessel 28, and load cell 30 senses the weight of pressure vessel 28 and its contents or a change in weight of pressure vessel 28. These sensed operating parameters are sent as sensor signals from each of cycle count reader 22, flow meter 26, and load cell 30, respectively electrically (or wirelessly) to controller 36. Controller 36 receives or collects the sensor signals and uses one or more of the sensed operating parameters together with an operator input setting from user interface 38 to determine appropriate control commands to be provided. Controller 36 then sends the control commands in the form of control signals to at least one of air regulator 16A and orifice valve 24A. The control signal sent from controller 36 to air regulator 16A can be used to adjust air regulator 16A in order to regulate the pressure at the outlet of water pump 18. The control signal sent from controller 36 to orifice valve 24A can be used to adjust orifice valve 24A in order to regulate the rate of flow of water from water pump 18 into pressure vessel 28. The rate of flow of the blast media slurry into the blast circuit is thus adjusted in response to at least one of the regulated outlet pressure of water pump 18 and the regulated rate of flow of water to pressure vessel 28.

Additionally, the blast media output of vapor blasting system 10 can be sensed and used with at least one of the sensed operating parameters of the cycle rate of water pump 18, the rate of flow of water into pressure vessel 28, and the rate of flow of the blast media slurry flowing out of pressure vessel 28 to determine an amount of adjustment of at least one of the cycle rate of water pump 18, the rate of flow of water into pressure vessel 28, and the rate of flow of the blast media slurry flowing out of pressure vessel 28.

With existing systems blasting systems, the blast system has to be engaged and blasting in order to set and fine tune the abrasive flow rate flowing from the applicator. However, any fluctuations in blast system pressures or adjustments to the blast air pressure require a subsequent adjustment and fine tuning of the blast media flow rate via manual adjustment (e.g., via trial and error) from the operator.

Vapor blasting system 10 with controller 36 allows the operator to choose a desired set point upon setting up vapor blasting system 10 without having to first engage (e.g., pressurize) vapor blasting system 10. An operator input setting that defines the desired set point can be entered using interface 38. Feedback related to the blast media flow rate is collected by controller 36 via measurements of operating parameters including but not limited to the cycle rate of water pump 18, the flow rate of water into pressure vessel 28, and/or the change in weight of pressure vessel 28. In one non-limiting embodiment, the cycle rate of water pump 18, flow rate of water into pressure vessel 28, and/or change in weight of pressure vessel 28 can be sensed by cycle count reader 22, flow meter 26, and load cell 30, respectively. Once any or all of these sensed parameters are received by controller 36, controller 36 can send control commands as needed in the form of control signals to air regulator 16A to adjust air regulator 16A so as to regulate the rate of airflow to motor 20A to drive water pump 18 and/or to orifice valve 24A to adjust orifice valve 24A so as to regulate the rate of flow of water into pressure vessel 28.

Instead of needing to engage vapor blasting system 10 and blasting in order to set and fine tune the abrasive flow rate, controller 36 can automatically adjust the rate of flow of blast media slurry into the blast circuit (e.g., a blast line and applicator 34) in response to at least one of the sensed parameters and stored operator inputs received from user interface 38 that define the desired set point. When the operator decides to change the desired set point, new operator input settings are provided to controller 36 through user interface 38.

For example, this method allows the operator to set a desired blast media flow rate faster, and with more accuracy and precision than existing methods. Vapor blasting system 10 with controller 36 does not require that vapor blasting system 10 be engaged and blasting in order to set and fine tune the blast media flow rate. Vapor blasting system 10 with controller 36 allows the operator to choose a desired blast media flow rate set point before and/or upon setting up vapor blasting system 10 without having to first be blasting with vapor blasting system 10. Additionally, any fluctuations in system pressures or adjustments to the blast air pressure do not require a subsequent adjustment and fine tuning of the blast media flow rate. Vapor blasting system 10 with controller 36 enables the blast media flow rate to remain accurate and consistent over a period of time.

Figure 1B:
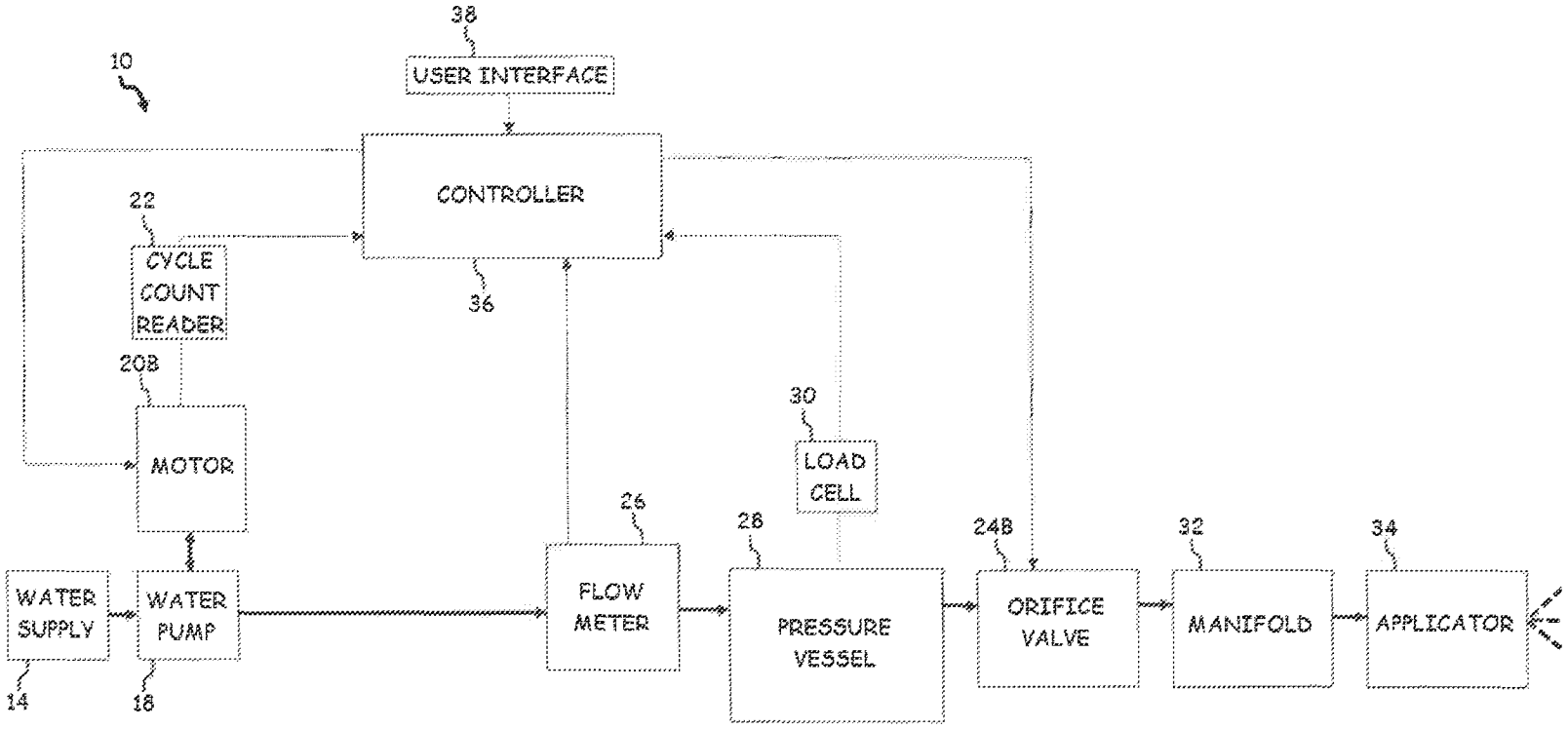
FIG. 1B is a block diagram of a vapor blasting system with an electrically driven motor.

FIG. 1B is a block diagram of vapor blasting system 10. In this embodiment, vapor blasting system 10 includes water supply 14, water pump 18, motor 20B, cycle count reader 22, orifice valve 24B, flow meter 26, pressure vessel 28, load cell 30, manifold 32, applicator 34, controller 36, and user interface 38. FIG. 1B includes similar components as FIG. 1A, except for that motor 20B includes an electric motor and orifice valve 24B is at a different location than orifice valve 24A. Additionally, FIG. 1B omits air supply 12A and air regulator 16A due to motor 20B being an electric motor instead of a pneumatic motor. Besides these differences, all of the other elements are included in FIG. 1B are similar and include a similar function as to those discussed with respect to FIG. 1A.

In the non-limiting embodiment shown in FIG. 1B, motor 20B is an electric motor. In other non-limiting embodiments, motor 20B can include any other type of motor. Cycle count reader 22 is a sensor that senses pump strokes of motor 20B or water pump 18. In one non-limiting embodiment, cycle count reader 22 is a sensor that senses current to motor 20B or water pump 18, so that the speed of motor 20B and thus pump strokes or pump output can be derived. Orifice valve 24B is an adjustable flow regulating device or valve. In one non-limiting embodiment, orifice valve 24B can be a needle valve with a tapered pin which gradually opens a space for finely tuned control of flow.

Water supply 14 is fluidly connected to water pump 18. Water pump 18 is mechanically and driven by motor 20B. Motor 20B is fluidly and mechanically connected to water pump 18 via a frame and a piston. Cycle count reader 22 is positioned in close proximity to motor 20B such that cycle count reader 22 senses each stoke or cycle of motor 20B (which is indicative of a cycle rate of water pump 18). Orifice valve 24B is fluidly connected to (and can be attached to) the blast media outlet of pressure vessel 28. Manifold 32 is fluidly connected to orifice valve 24B and to applicator 34. Applicator 34 is fluidly connected to manifold 32. Controller 36 is electrically connected to, cycle count reader 22, orifice valve 24B, flow meter 26, and load cell 30. Controller 36 is configured to receive electrical signals from cycle count reader 22 and load cell 30. Controller 36 is configured to send electrical signals to water pump 18, flow meter 26, and orifice valve 24B.

During operation of vapor blasting system 10, cycle count reader 22 senses a cycle rate of water pump 18 (for example, by sensing strokes or cycles of water pump 18 or motor 20B), flow meter 26 senses a flow rate of water flowing into pressure vessel 28, and load cell 30 senses the weight of pressure vessel 28 and its contents or a change in weight of pressure vessel 28. These sensed operating parameters are sent as sensor signals from each of cycle count reader 22, flow meter 26, and load cell 30, respectively electrically (or wirelessly) to controller 36. Controller 36 receives or collects the sensor signals and uses one or more of the sensed operating parameters together with operator input setting from user interface 38 to determine appropriate control commends to be provided. Controller 36 then sends the control commands in the form of control signals to orifice valve 24B. The control signal sent from controller 36 to orifice valve 24B can be used to adjust orifice valve 24B in order to regulate the rate of flow blast media slurry flowing out of pressure vessel 28, to the blast circuit formed by manifold 32 and applicator 34. The rate of flow of the blast media slurry into the blast circuit is thus adjusted in response to the regulated rate of flow of the blast media slurry flowing out of pressure vessel 28 to the blast circuit.

Additionally, the blast media output of vapor blasting system 10 can be sensed and used with the rate of flow of the blast media slurry flowing out of pressure vessel 28 to determine an amount of adjustment of the rate of flow of the blast media slurry flowing out of pressure vessel 28.

Vapor blasting system 10 with controller 36 allows the operator to choose a desired set point upon setting up vapor blasting system 10 without having to first engage (e.g., pressurize) vapor blasting system 10. An operator input setting that defines the desired set point can be entered via user interface 38. Feedback related to the blast media flow rate is collected by controller 36 via measurements of operating parameters including but not limited to the cycle rate of water pump 18, the flow rate of water into pressure vessel 28, and/or the change in weight of pressure vessel 28. In one non-limiting embodiment, the cycle rate of water pump 18, flow rate of water into pressure vessel 28, and/or change in weight of pressure vessel 28 can be sensed by cycle count reader 22, flow meter 26, and load cell 30, respectively. Once any or all of these sensed parameters are received by controller 36, controller 36 can send control commands as needed in the form of control signals to orifice valve 24B to adjust orifice valve 24B so as to regulate the rate of flow of the blast media slurry flowing out of pressure vessel 28 to the blast circuit.

Figure 2:
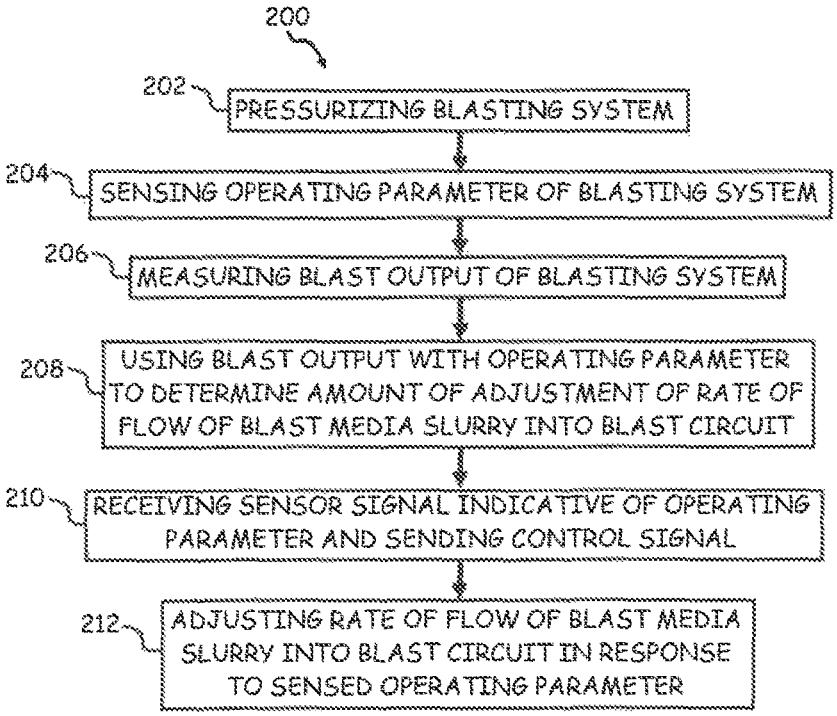
FIG. 2 is a flowchart of a first method of controlling a rate of flow of blast media in the vapor blasting system.

FIG. 2 shows a flowchart of method 200, which includes steps 202-212. Step 202 includes pressurizing vapor blasting system 10. Steps 204 includes sensing an operating parameter of vapor blasting system 10. In one non-limiting embodiment, the sensed operating parameter can comprise at least one of the cycle rate of water pump 18, the rate of flow of water into pressure vessel 28, and the change in weight of pressure vessel 28. Step 206 includes sensing the blast media output of vapor blasting system 10. In one non-limiting embodiment, the blast media output of vapor blasting system 10 can be sensed by a flow meter (not shown in FIGS. 1A or 1B) attached to applicator 34. Step 208 includes using the blast media output with the operating parameter to determine an amount of adjustment of the rate of flow of blast media slurry into the blast circuit. Step 210 includes receiving with controller 36 a sensor signal indicative of the operating parameter and sending a control signal with a control command to at least one of air regulator 16A, water pump 18, orifice valve 24A, and orifice valve 24B.

Step 212 includes adjusting the rate of flow of blast media slurry into the blast circuit in response to the sensed operating parameter. In one non-limiting embodiment, adjusting the rate of flow of blast media slurry into the blast circuit can comprise regulating the cycle rate of water pump 18 by sending a control signal with a control command from controller 36 to adjust the outlet pressure of water pump 18. In another non-limiting embodiment, adjusting the rate of flow of blast media slurry into the blast circuit can comprise regulating the rate of flow of water into pressure vessel 28 by sending a control signal with a control command from controller 36 to adjust orifice valve 24A connected to a pump outlet of water pump 18. In another non-limiting embodiment, adjusting the rate of flow of blast media slurry into the blast circuit can comprise regulating the rate of flow of the media slurry flowing out of pressure vessel 28 by sending a control signal with a control command from controller 36 to adjust orifice valve 24B connected to a media outlet port of pressure vessel 28.

Figure 3A:
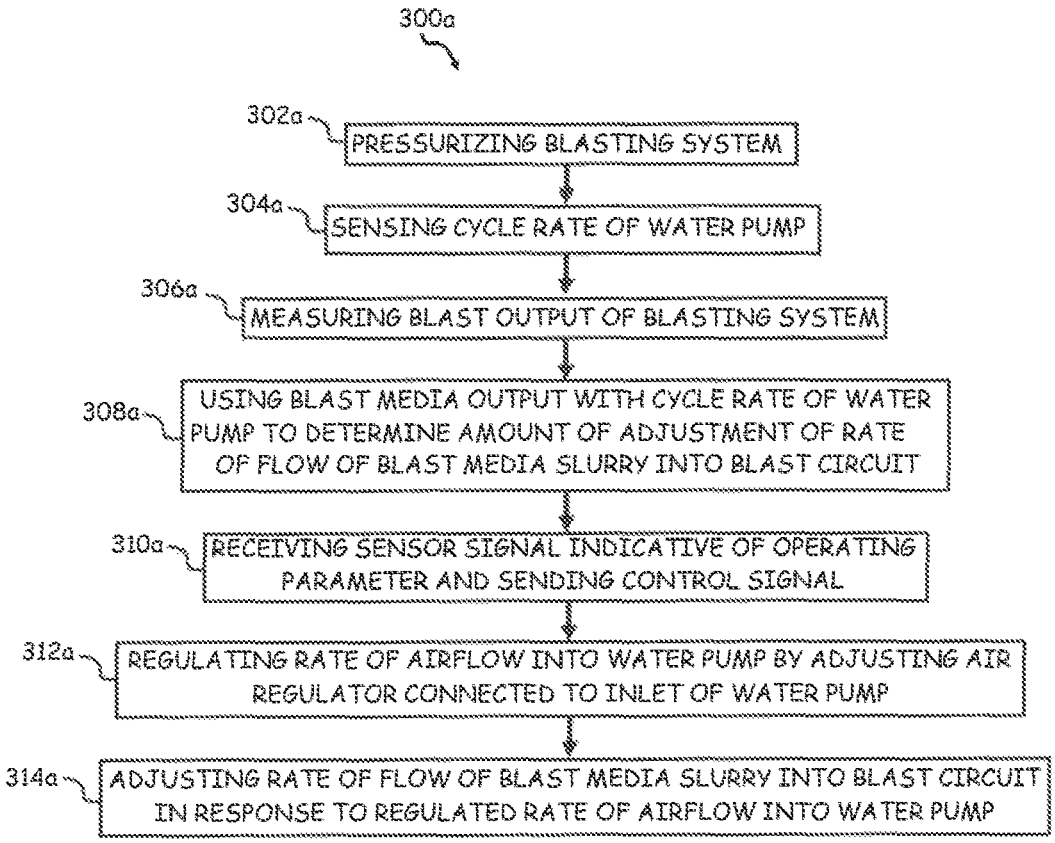
FIG. 3A is a flowchart of a second method of controlling a rate of flow of blast media in the vapor blasting system.

FIG. 3A shows a flowchart of method 300*a*, which includes steps 302*a*-314*a*. Step 302*a* includes pressurizing vapor blasting system 10. Step 304*a* includes sensing an operating parameter (e.g., cycle rate) of water pump 18 (for example, by sensing strokes or cycles of motor 20A) with cycle count reader 22. Step 306*a* includes sensing the output of vapor blasting system 10 (e.g., blast media output rate). Step 308*a* includes using the output with the sensed operating parameter of water pump 18 (e.g., cycle rate) to determine an amount of adjustment of the rate of flow of blast media slurry into the blast circuit. Step 310*a* includes receiving with controller 36 a sensor signal indicative of the operating parameter and sending a control signal with a control command to air regulator 16A. Step 312*a* includes regulating, in response to the sensor signal (e.g. cycle rate) of water pump 18, the rate of airflow into water pump 18 by sending a control signal with a control command from controller 36 to adjust air regulator 16A connected to the pump inlet of water pump 18. Step 314*a* includes adjusting a desired set point of an output of vapor blast system 10 (e.g., the rate of flow of blast media slurry into the blast circuit) in response to the control signals from controller 36.

Figure 3B:
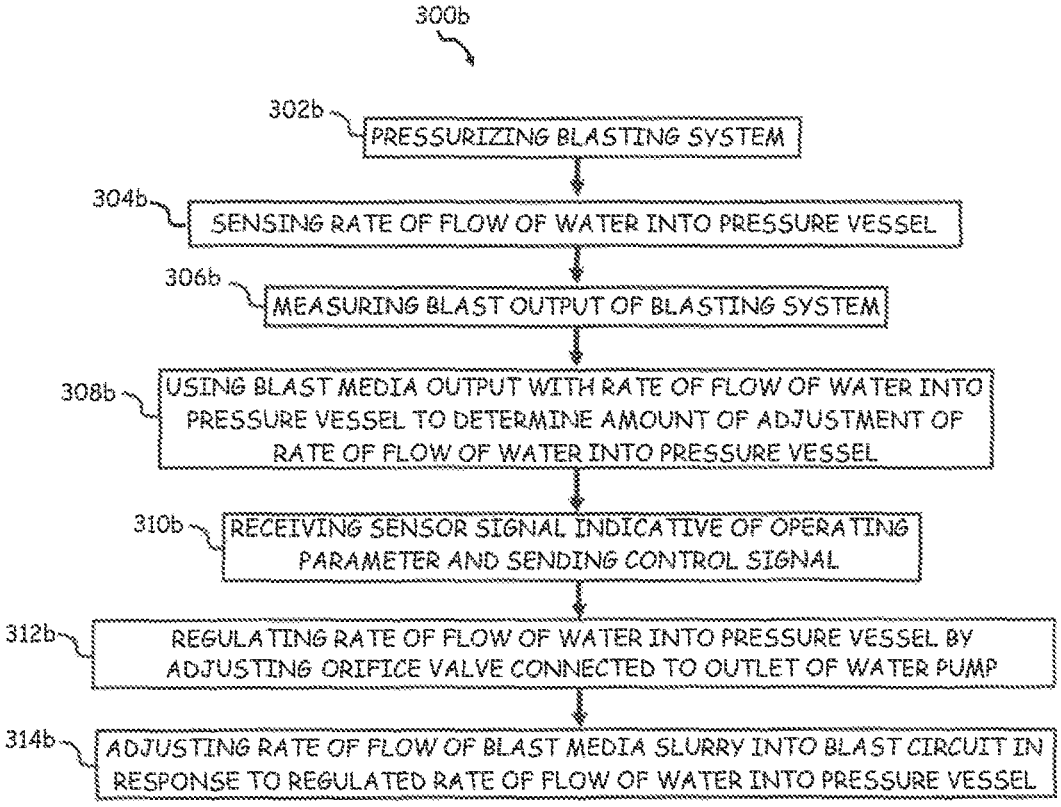
FIG. 3B is a flowchart of a third method of controlling a rate of flow of blast media in the vapor blasting system.

FIG. 3B shows a flowchart of method 300*b*, which includes steps 302*b*-314*b*. Step 302*b* includes pressurizing vapor blasting system 10. Step 304*b* includes sensing an operating parameter (e.g., the rate of flow of water into pressure vessel 28). Step 306*b* includes sensing the output of vapor blasting system 10 (e.g., blast media output rate). Step 308*b* includes using the output with the sensed operating parameter (e.g., flow of water into pressure vessel 28) to determine an amount of adjustment of the rate of flow of blast media slurry into the blast circuit. Step 310*b* includes receiving with controller 36 a sensor signal indicative of the operating parameter and sending a control signal with a control command to orifice valve 24A. Step 312*b* includes regulating, in response to the sensor signal (e.g., sensed rate of flow of water into pressure vessel 28), the rate of flow of water into pressure vessel 28 by sending a control signal with a control command from controller 36 to adjust orifice valve 24A connected to the pump outlet of water pump 18. Step 314*b* includes adjusting a desired set point of an output of vapor blast system 10 (e.g., the rate of flow of blast media slurry into the blast circuit) in response to the control signals from controller 36.

Figure 3C:
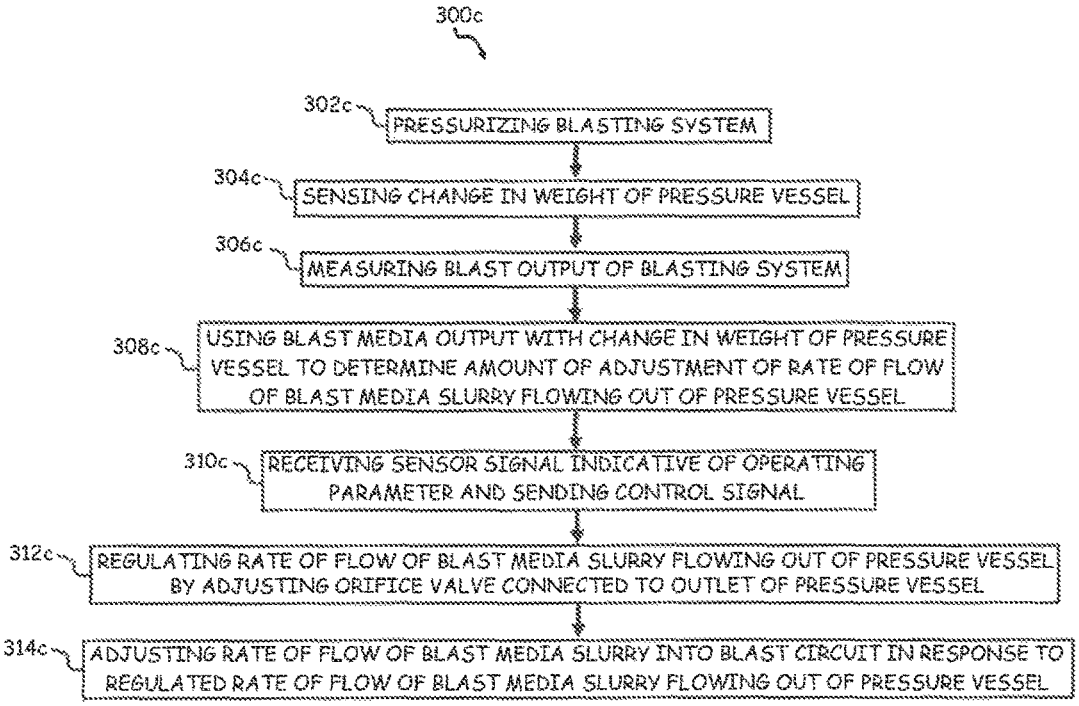
FIG. 3C is a flowchart of a fourth method of controlling a rate of flow of blast media in the vapor blasting system.

FIG. 3C shows a flowchart of method 300*c*, which includes steps 302*c*-314*c*. Step 302*c* includes pressurizing vapor blasting system 10. Step 304*c* includes sensing an operating parameter (e.g., change in weight of pressure vessel 28) with load cell 30. Step 306*c* includes sensing the output of vapor blasting system 10 (e.g., blast media output rate). Step 308*c* includes using the output with the sensed operating parameter (e.g., change in weight of pressure vessel 28) to determine an amount of adjustment of the rate of flow of blast media slurry into the blast circuit. Step 310*c* includes receiving with controller 36 a sensor signal indicative of the operating parameter and sending a control signal with a control command to orifice valve 24B. Step 312*c* includes regulating, in response to the sensor signal (e.g., change in weight of pressure vessel 28), the rate of flow of the blast media slurry flowing out of pressure vessel 28 by sending a control signal with a control command from controller 36 to adjust orifice valve 24B connected to media outlet port 52 of pressure vessel 28. Step 314*c* includes adjusting desired set point of an output of vapor blast system 10 (e.g., the rate of flow of blast media slurry into the blast circuit) in response to the control signals from controller 36.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A blasting system comprising:

a pressure vessel that is configured to contain a pressurized blast media slurry;

a water pump that pumps water from a water supply to the pressure vessel;

a blast circuit that delivers the pressurized blast media slurry received from the pressure vessel;

a motor that drives the water pump;

an orifice valve that regulates a rate of flow of the blast media slurry to the blast circuit; and a controller configured to provide control commands to the water pump or to the orifice valve based on a blast media flow rate set point and at least one sensed operating parameter in order to adjust the rate of flow of blast media slurry into the blast circuit; wherein the controller comprises a user interface configured to allow an operator to receive and view output data and enter input data and control settings into the controller, wherein the blast media flow rate set point is defined by the sensed operating parameter and input data.

2. The blasting system of claim 1, wherein the at least one sensed operating parameter is indicative of at least one of a cycle rate of the water pump, the rate of flow of water from the water pump to the pressure vessel, or a change in weight of the pressure vessel.

3. The blasting system of claim 2 further comprising a cycle count reader sensor configured to sense the cycle rate of the water pump and to send a sensor signal to the controller.

4. The blasting system of claim 2 further comprising a load cell scale configured to sense the change in weight of the pressure vessel and to send a sensor signal to the controller.

5. The blasting system of claim 2 further comprising a flow meter configured to sense the rate of flow of water from the water pump to the pressure vessel and to send a sensor signal to the controller.

6. The blasting system of claim 1, wherein the orifice valve regulates a rate of flow of water from the water pump to the pressure vessel.

7. The blasting system of claim 1, wherein the orifice valve regulates a rate of flow of the blast media slurry to the blast circuit.

8. A method of controlling a rate of flow of blast media in a blasting system that includes a water pump, a pressure vessel, a blast circuit, a first orifice valve, and a controller, the method comprising:

receiving, at the controller, a blast media flow rate set point;

sensing an operating parameter of the blasting system; and receiving, at the controller, a sensor signal indicative of the operating parameter; and sending an operator input setting from a user interface and a control signal to at least one of the water pump and the first orifice valve to adjust a rate of flow of blast media slurry into the blast circuit based on the blast media flow rate set point and the sensed operating parameter, wherein the blast media flow rate set point is defined by the sensed operating parameter and input setting.

9. The method of claim 8, wherein the operating parameter comprises a cycle rate of the water pump.

10. The method of claim 9, wherein adjusting the rate of flow of blast media slurry into the blast circuit comprises regulating a cycle rate of the water pump based on the control signal from the controller.

11. The method of claim 9, wherein adjusting the rate of flow of blast media slurry into the blast circuit comprises regulating the rate of flow of water into the pressure vessel by adjusting the first orifice valve connected between the water pump and the pressure vessel based on the control signal from the controller.

12. The method of claim 9, wherein adjusting the rate of flow of blast media slurry into the blast circuit comprises regulating a rate of flow of a media slurry flowing out of the pressure vessel by adjusting a second orifice valve connected between the pressure vessel and the blast circuit based on the control signal from the controller.

13. The method of claim 8 wherein adjusting the rate of flow of blast media slurry into the blast circuit comprises regulating, based on the set point and the operating parameter, a cycle rate of the water pump by based on a first control signal from the controller.

14. The method of claim 8, wherein the operating parameter comprises a change in weight of the pressure vessel.

15. The method of claim 8 wherein adjusting the rate of flow of blast media slurry into the blast circuit comprises regulating, based on the set point and the operating parameter, a rate of flow of a blast media slurry flowing out of the pressure vessel by adjusting a second orifice valve connected between the pressure vessel and the blast circuit based on a third control signal from the controller.

* * * * *